United States Patent [19]

Ortega

[11] Patent Number: 4,888,892

[45] Date of Patent: Dec. 26, 1989

[54] SCENIC VARIATION SYSTEMS

[76] Inventor: Fernando M. Ortega, C/ Antonio Lorenzo Hurtado No. 1, 47014, Valladolid, Spain

[21] Appl. No.: 136,371

[22] Filed: Dec. 22, 1987

[30] Foreign Application Priority Data

Dec. 24, 1986 [ES] Spain ..... 8603597

[51] Int. Cl.[4] ..... G09F 19/00

[52] U.S. Cl. ..... 40/430; 272/22

[58] Field of Search ..... 40/446, 503, 430, 160; 272/11, 22

[56] References Cited

U.S. PATENT DOCUMENTS

| | | | |
|---|---|---|---|
| 885,669 | 4/1908 | Delloye et al. | 272/22 |
| 984,322 | 2/1911 | Van Sant | 272/22 |
| 1,147,823 | 7/1915 | Smith | 272/22 |
| 1,893,167 | 1/1933 | Glagolin | 272/22 |
| 2,136,833 | 11/1938 | Young | 272/22 |
| 3,406,476 | 10/1968 | Wilcox | 40/430 |
| 3,475,845 | 11/1969 | Estvan, Jr. | 40/430 |
| 4,461,106 | 7/1984 | Lawson | 40/430 |

*Primary Examiner*—Gene Mancene
*Assistant Examiner*—Cary E. Stone
*Attorney, Agent, or Firm*—Ostrolenk, Faber, Gerb & Soffen

[57] ABSTRACT

Scenery subassemblies are rotated around arises of a polyhedron. As the subassemblies are rotated, the scenery above, beneath, and all around an observation point changes. The polyhedron an be an octahedron, cube, or tetrahedron.

7 Claims, 4 Drawing Sheets

SCENIC VARIATION SYSTEMS

BACKGROUND OF THE INVENTION

1. Field of the Invention

This invention represents an improvement in systems of the type that modify the setting surrounding a given space.

2. Description of the Related Art

In prior art systems, this change has been accomplished either by turning three triangular prisms of a vertical movable axis with three decors on its faces, or by the continuous lifting of curtains symbolizing different scenes.

In the prior art, scenery modifications have been accomplished by the combined action of mechanisms that change a limited part of the environment surrounding a given space.

SUMMARY OF THE INVENTION

The invention obtains a complete change in the setting surrounding a given zone.

The change takes place in every possible direction, i.e., above, beneath, and all around a defined space.

In this way, a complete modification of the surrounding decor (in different temporary sequences) is achieved. The number of sequences depends on the geometric form chosen to accomplish the spatial division of the setting.

In the following, a scenic variation in three stages is described. The variation can be performed using a system defined by an octahedron:

The separator can be on a platform in the middle of the octahedral system or on a bridge hanging between two facing vertices of the octahedron. (An octahedron is a polyhedron with eight triangular sides.) From the platform or the bridge, the spectator could be looking at a wooded setting with profuse vegetation all around. The trees as well as the rest of the decor would be three-dimensional.

With the invention, a change in the decor takes place such that, without changing position, the spectator is plunged into totally different scenery such as a mountain-face surrounded by snow peaks, a different sky, different terrain and, in short, a totally new setting.

Using the invention, spectators could find themselves once again in another setting (for example, in the cosmos surrounded by plants, planets and asteroids) again without changing their initial position.

Such decors are not fictitious or obtained by optical techniques. Rather, the decor is built in three dimensions, with the result that they are quite tangible. The decors can be combined with visual projection and sound projection.

The system of the invention can be seen as something new as it is the consequence of geometric research never before carried out.

Its usefulness is great, as a show it produces astonishment on the part of the spectator when he or she observes how the whole setting changes in a three-dimensional way.

In theatre and opera, scenic variation has been sectorial, i.e., it has only been able to cover a portion of the spectators' environment. That is, the prior art includes means for changing three dimensional scenery but only the scenery facing the spectators.

The advantages of the invention are clear; the invention can be used to readily bring about a complete modification of the entire scenery during a theatrical production. Further, the scenery may be three-dimensional.

Spectators are astonished and surprised upon observing the effects of the invention. The spectators are left puzzled and without spatial reference.

The objects and advantages of the present invention will become apparent from the following detailed description of a preferred embodiment in conjunction with the drawings.

DESCRIPTION OF THE PREFERRED EMBODIMENTS

The invention is directed to a system for constantly changing the scenery surrounding a central observation point. Three different preferred embodiments of the invention are described herein. Each of these embodiments is based on a different geometric structure. The three geometric structures are defined as follows:

TETRAHEDRON: Four planes encircling a central observation point. Dihedral angles equal to 72°. Five dihedral sectors. Five sceneries.

CUBE: Six planes surrounding a central observation point. Dihedral angles equal to 90°. Four dihedral sectors. Four sceneries.

OCTAHEDRON: Eight planes surrounding a central observation point, Dihedral angles equal to 120°. Three dihedral sectors. Three sceneries.

In each preferred embodiment, the change in scenery is due to rotation of the scenery subassembies around cylindrical supports (2) which are arranged so as to define the arrises of a polyhedron. The geometric shape of each embodiment is determined by producing a division with rotational symmetry centered on the polygons forming the faces of the corresponding structure.

When the scenery subassemblies rotate around their respective cylindrical supports (2), a spectator will observe (from a viewpoint both central to and surrounded by the scenery subassemblies) the changing inside faces of the scenery subassemblies. The number of scenery changes per rotation corresponds to the chosen geometric structure.

Thus, it is possible to carry out what is called the "total scenic variation" by setting decors and representations of three-dimensional figures on the sides of each scenery subassembly.

The rotation of each scenery subassembly around its respective cylindrical support (2) is coordinated by gears which, connected together, move all the subassemblies by external impetus.

Figure 1:
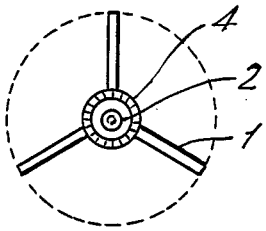
FIG. 1 is a top plan view of a scenery subassembly corresponding to an octahedral embodiment of the invention.
Figure 2:
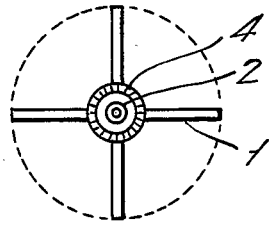
FIG. 2 is a top plan view of a scenery subassembly corresponding to a cubical embodiment of the invention.
Figure 3:
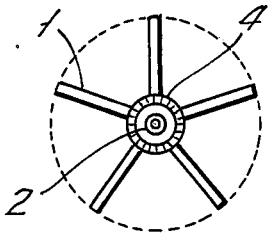
FIG. 3 is a top plan view of a scenery subassembly corresponding to a tetrahedral embodiment of the invention.

As illustrated in FIGS. 1, 2, and 3, each scenery subassembly consists of cylindrical supports (2) surrounded by 3, 4, or 5 planar sectors (1) arranged with equl dihedral angles of 120°, 90°, 72°, respectively. The number of planar sectors (1) is different in each of the preferred embodiments.

The means (4) for simultaneously rotating the cylindrical supports (2) are located at the ends of the supports (2).

Figure 4:
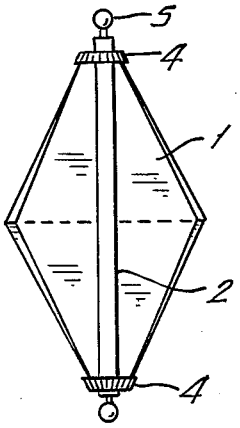
FIG. 4 is a side view of the subassembly illustrated in FIG. 1.
Figure 5:
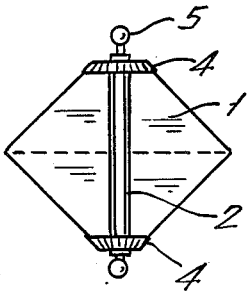
FIG. 5 is a side view of the subassembly illustrated in FIG. 2.
Figure 6:
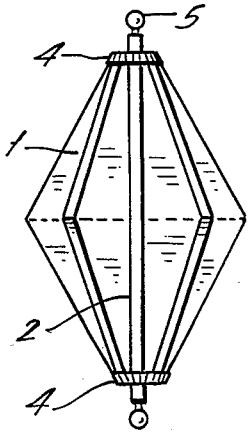
FIG. 6 is a side view of the subassembly illustrated in FIG. 3.

As illustrated in FIGS. 4 through 6, the planar sectors (1) have shapes dependent on the particular embodiment (an isosceles triangle with an area equal to $\frac{1}{3}$ of a side of the octahedral or tetrahedral embodiment (FIGS. 4 and 6) or an isosceles triangle with an area equal to $\frac{1}{4}$ of a square side of the cubical embodiment).

As illustrated in FIGS. 7, 8, 9, 10, 11, and 12, there is a formal correspondence of recurrences and spatial distribution of the planar sectors (1) with respect to the geometry of the particular embodiment. The geometry of the particular embodiment is defined by its arrises (3). The cylindrical supports (2) are positioned along the arrises (3) of the particular embodiment. The scenery subassemblies (1) rotate together in a coordinated and independent way around the cylindrical supports (2).

Figure 13:
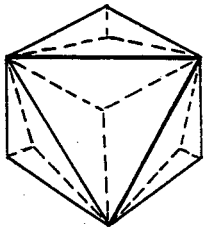
FIG. 13 is a perspective view of an octahedron whose sides have been divided into equi-sized triangles which are rotationally symmetrical about an arris.
Figure 14:
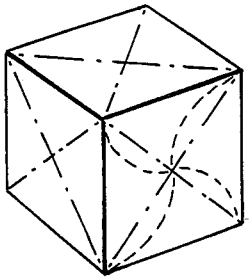
FIG. 14 is a perspective view of a cube whose sides have been divided into equi-sized triangules which are rotationally symmetrical about an arris. The edges of the triangles can be straight, irregular, or curved.
Figure 15:
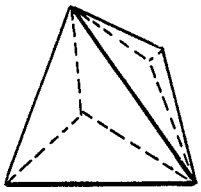
FIG. 15 is a perspective view of a tetrahedron whose sides have been divided into equi-sized triangles which are rotationally symmetrical about an arris.

As illustrated in FIGS. 13, 14, and 15, the triangular and square faces are divided into sectors which are symmetrical around the center of the faces of the polyhedron.

Figure 7:
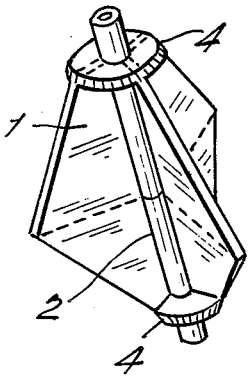
FIG. 7 is a perspective view of the subassembly of FIG. 1.
Figure 10:
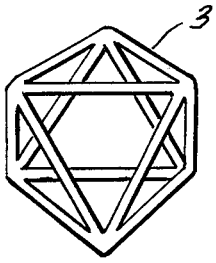
FIG. 10 is a perspective view of an octahedron.
Figure 16:
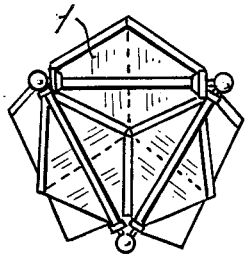
FIG. 16 is a perspective view of the octahedral embodiment of the invention.

FIG. 16 illustrates the result of inserting onto cylindrical supports arranged on each arris (3) of the octahedron of FIG. 10 the scenery subassembly of FIG. 7. The result is the octehedral embodiment with three possible decors.

Figure 8:
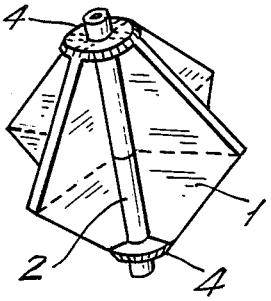
FIG. 8 is a perspective view of the subassemly of FIG. 2.
Figure 11:
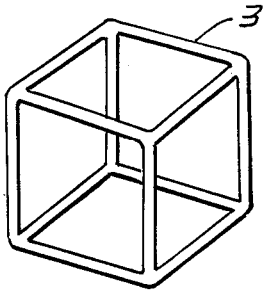
FIG. 11 is a perspective view of a cube.
Figure 17:
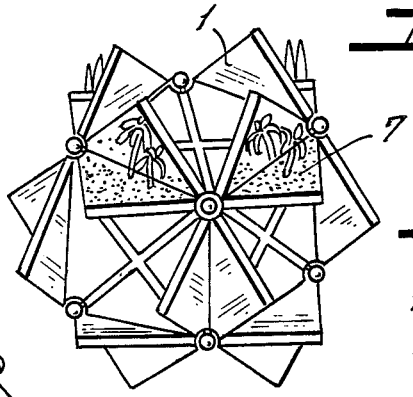
FIG. 17 is a perspective view of the cubical embodiment of the invention.

FIG. 17 illustrates the result of inserting onto cylindrical supports arranged on each arris (3) of the cube of FIG. 11 the scenery subassembly of FIG. 8. The result is the cubical embodiment with four possible decors (7).

The embodiment illustrated in FIG. 17 includes three-dimensional decors (7) that can be touched, in particular, trees (7). The trees (7) can be seen from inside of the cube once the scenery are rotated around cylindrical supports defined along the arrises (3).

Figure 9:
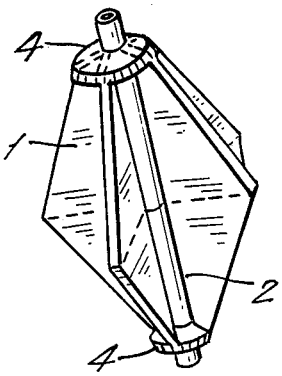
FIG. 9 is a perspective view of the subassembly of FIG. 3.
Figure 12:
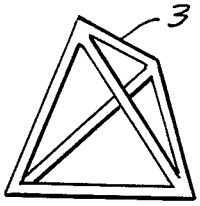
FIG. 12 is a perspective view of a tetrahedron.
Figure 18:
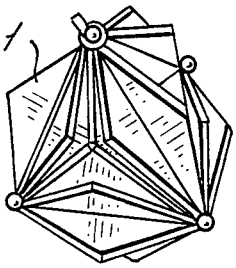
FIG. 18 is a perspective view of the tetrahedral embodiment of the invention.

FIG. 18 illustrates the result of locating along each arris (3) of the tetrahedron of FIG. 12 the scenery subassembly of FIG. 9.

FIGS. 1, 4, and 7 are different views of the same scenery subassembly. The subassembly is located alone each arris (3) illustrated in FIG. 10.

FIGS. 2, 5, and 8 are different views of the same scenery subassembly. The subassembly is located along each the arris (3) illustrated in FIG. 11.

FIGS. 3, 6, and 9 are different views of the same scenery subassembly. The subassembly is located along each arris (3) illustrated in FIG. 12.

Figure 19:
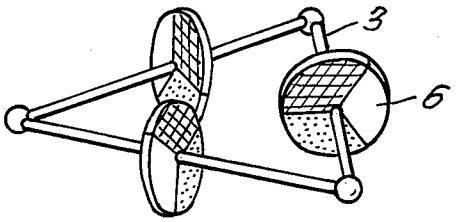
FIG. 19 is a schematic, perspective view of a portion of the octahedral embodiment. Three arrises of an octahedron are illustrated with discs in the central part of each arris. The discs are divided in thirds to represent different sceneries.
Figure 21:
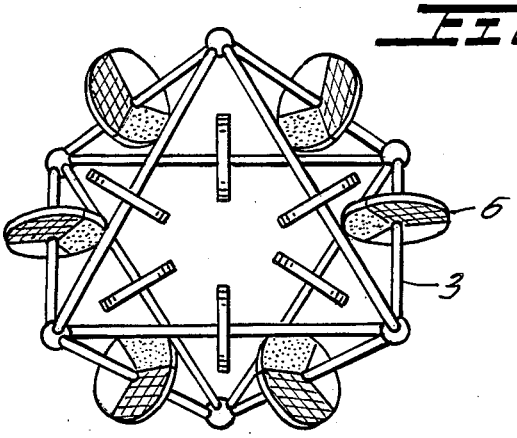
FIG. 21 is a schematic, top plan view similar to FIG. 19, but of a complete octahedron.

FIGS. 19 and 21 schematically illustrate how the octahedral system works with three different decors (black, dots, and white).

There may be seen from the center of the octahedral embodiment three sequences, and each of decors are seen as the discs (6) are rotated around the arrises (3).

Figure 20:
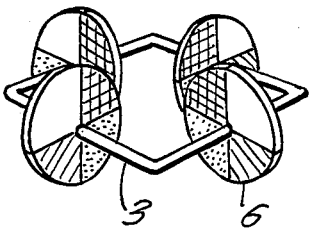
FIG. 20 is a schematic, perspective view similar to FIG. 19, but corresponding to the cubical embodiment.
Figure 22:
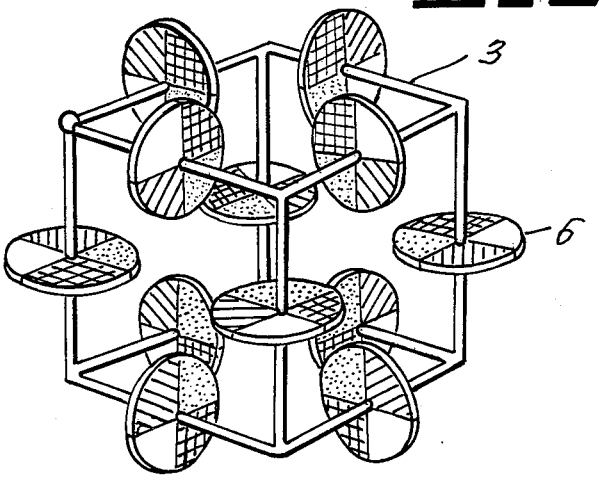
FIG. 22 is a schematic, perspective view similar to FIG. 21, but corresponding to the cubical embodiment.

FIGS. 20 and 22 schematically illustrate how the cubical embodiment works with four different decors (black, dots, stripes, and white).

Figure 23:
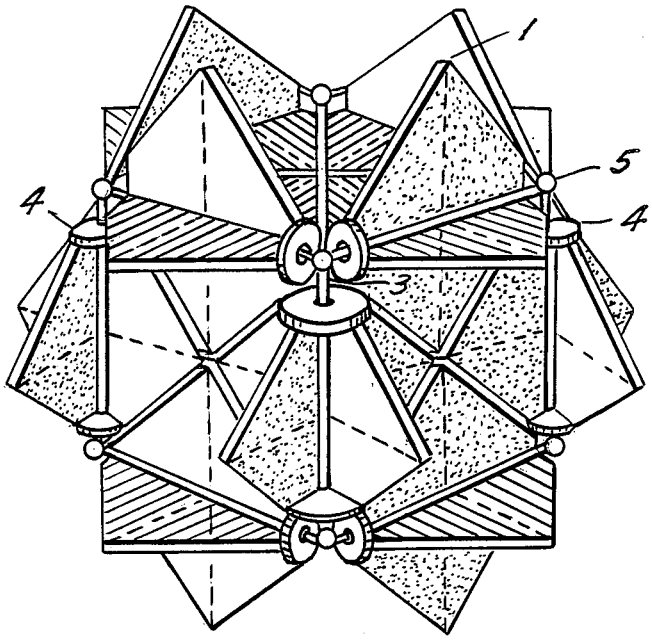
FIG. 23 is a perspective view of the cubical embodiment of the invention.

FIG. 23 is a schematic, perspective view of the cubical embodiment showing four concurring planes (1) arranged 90° apart from each other. Rotation is regulated by the means (4). All four planes rotate around the respective cylindrical supports. The cylindrical supports are joined to each other as illustrated at (5).

Figure 24:
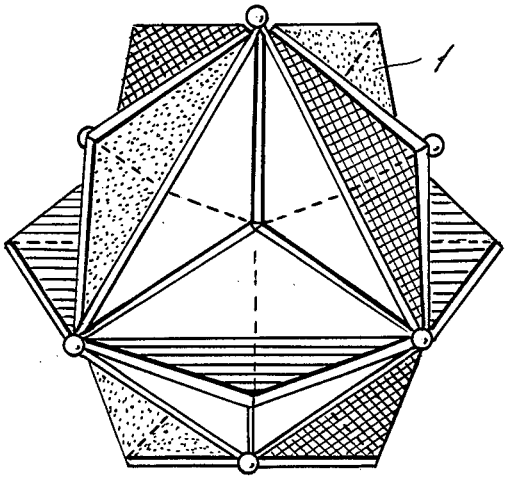
FIG. 24 is a perspective view of the octahedral embodiment of the invention.

FIG. 24 is a perspective view of the octahedral embodiment with three concurring planar sectors (1) arranged 120° apart from one another.

Although the invention has been described in connection with preferred embodiments thereof, many variations and modifications may become apparent to those skilled in the art. It is preferred, therefore, that the invention be limited not by the specific disclosure herein, but only by the appended claims.

What is claimed is:

1. A system for changing scenery, said system comprising:

(A) an observation point;

(B) a plurality of scenery subassemblies for providing scenery observable above, beneath, and all around said observation point, each of said scenery subassemblies having an axis and two ends, said scenery subassemblies being arranged end-to-end with said axes defining the arrises of a polyhedron, each of said scenery subassemblies including:

(1) a plurality of planar sectors, said planar sectors forming equal dihedral angles; and (2) scenery located on or between said planar sectors; and (C) means for simultaneously rotating said scenery subassemblies about their respective axes to change said scenery observable above, beneath, and all around said observation point.

2. The system of claim 1, wherein:

said system further comprises means for rotatably supporting said subassemblies; and each of said subassemblies includes a cylinder, each one of said cylinders being rotatably supported.

3. The system of claim 2, wherein each of said sectors defines an isosceles triangle with two equal sides, the third, non-equal side of each of said triangular sectors being parallel to and joined to one of said cylinders.

4. The system of claim 3, wherein said scenery located on or between said sectors, is three-dimensional.

5. The system of claim 1, wherein said sectors define dihedral angles of 120° and said polyhedron is an octahedron.

6. The system of claim 1, wherein said sectors define dihedral angles of 90° and said polyhedron is a cube.

7. The system of claim 1, wherein said sectors define dihedral angles of 72° and said polyhedron is a tetrahedron.

* * * * *